US010345017B2

(12) United States Patent
Choueifati et al.

(10) Patent No.: US 10,345,017 B2
(45) Date of Patent: Jul. 9, 2019

(54) MULTI-CIRCUIT COOLING ELEMENT FOR A REFRIGERATION SYSTEM

(71) Applicant: Hill Phoenix, Inc., Conyers, GA (US)

(72) Inventors: Jules G. Choueifati, Richmond, VA (US); Timothy D. Swofford, Midlothian, VA (US)

(73) Assignee: Hill Phoenix, Inc., Conyers, GA (US)

( * ) Notice: Subject to any disclaimer, the term of this patent is extended or adjusted under 35 U.S.C. 154(b) by 107 days.

(21) Appl. No.: 15/602,920

(22) Filed: May 23, 2017

(65) Prior Publication Data

US 2017/0343255 A1 Nov. 30, 2017

Related U.S. Application Data

(60) Provisional application No. 62/341,731, filed on May 26, 2016.

(51) Int. Cl.
*F25B 39/00* (2006.01)
*A47F 3/04* (2006.01)
(Continued)

(52) U.S. Cl.
CPC ..... *F25B 39/00* (2013.01); *A47F 3/0447* (2013.01); *A47F 3/0469* (2013.01);
(Continued)

(58) Field of Classification Search
CPC ..... F25B 25/005; F25B 39/00; F25B 49/02; F25B 2400/06; F25B 2600/13; A47F 3/0447; A47F 3/0469; A47F 3/0478
See application file for complete search history.

(56) References Cited

U.S. PATENT DOCUMENTS 6,397,618 B1 * 6/2002 Chu ..... F25B 25/00 165/104.22
9,746,209 B2 8/2017 Shaprio et al.
(Continued)

FOREIGN PATENT DOCUMENTS

WO WO-2009148199 A1 * 12/2009 ..... F25B 39/00
WO WO 2015/138051 9/2015
WO WO 2015/138052 9/2015

OTHER PUBLICATIONS

Bericht, "The Eco-Efficiency-Concept": Contribution to the methodology for energy using products within the scope of the EuP Directive, Jul. 17, 2007, Informationszentrum Wärmepumpen und Kältetechnik, 149 pages.
(Continued)

*Primary Examiner* — Marc E Norman
(74) *Attorney, Agent, or Firm* — Foley & Lardner LLP

(57) ABSTRACT

A temperature controlled case includes a housing that defines a temperature controlled space and a multi-circuit cooling element in thermal communication with the temperature controlled space. The multi-circuit cooling element includes two or more cooling coils. Each of the cooling coils is coupled to a different circuit structured to selectively circulate coolant through the multi-circuit cooling element. Each circuit is fluidly separate from each remaining circuit such that the coolant circulated through each circuit is not shared with each remaining circuit. The multi-circuit cooling element further includes a plurality of heat exchange fins coupled to each of the two or more cooling coils such that each of the heat exchange fins facilitates heat removal from the temperature controlled space by each of the two or more cooling coils.

20 Claims, 5 Drawing Sheets

(51) Int. Cl.
*F25B 25/00* (2006.01)
*F25B 49/02* (2006.01)

(52) U.S. Cl.
CPC ..... *A47F 3/0478* (2013.01); *F25B 25/005* (2013.01); *F25B 49/02* (2013.01); *F25B 2400/06* (2013.01); *F25B 2600/13* (2013.01)

(56) References Cited

U.S. PATENT DOCUMENTS

| | | | | |
|---|---|---|---|---|
| 2010/0107683 | A1* | 5/2010 | MacBain | F25B 1/00 62/510 |
| 2012/0011867 | A1* | 1/2012 | Koons | F25B 39/04 62/115 |
| 2015/0257548 | A1 | 9/2015 | Shapiro et al. | |
| 2015/0257549 | A1 | 9/2015 | Shapiro et al. | |
| 2017/0176077 | A1* | 6/2017 | Knatt | F25C 1/25 |

OTHER PUBLICATIONS

Pearson, Andy, "Carbon Dioxide—New Uses for an Old Refrigerant", Sep. 5, 2005, 9 pages.

Kazachki et al., Why secondary-coolant systems for supermarket refrigeration? International Refrigeration and Air Conditioning Conference at Purdue University, Paper 855, Jul. 17-20, 2006, 9 pps.

* cited by examiner

MULTI-CIRCUIT COOLING ELEMENT FOR A REFRIGERATION SYSTEM

CROSS-REFERENCE TO RELATED PATENT APPLICATION

This application claims the benefit of and priority to U.S. Provisional Patent Application No. 62/341,731 filed May 26, 2016, the entire disclosure of which is incorporated by reference herein.

TECHNICAL FIELD

The present disclosure relates to a temperature controlled case. More specifically, the present disclosure relates to a multi-circuit cooling element for a refrigeration system for a temperature controlled case.

BACKGROUND

Temperature controlled cases are used for the storage, preservation, and presentation of products, such as food products including perishable meat, dairy, seafood, produce, etc. These cases (e.g., refrigerated cases, freezers, merchandisers, etc.) are typically provided in both commercial (e.g., supermarkets, etc.) and residential settings. To facilitate the preservation of the products, temperature controlled cases often include one or more cooling systems for maintaining a display area of the case at a desired temperature.

The cooling systems may include one or more cooling elements (e.g., cooling coils, heat exchangers, evaporators, fan-coil units, etc.) through which a coolant is circulated (e.g., a liquid such as a glycol-water mixture, a refrigerant, etc.) to provide cooling to an internal cavity of the case. As a result of the cooling, the food products are typically maintained in a chilled state, which reduces a likelihood of spoilage for future retrieval and consumption.

SUMMARY

One implementation of the present disclosure is a temperature controlled case. The temperature controlled case includes a housing that defines a temperature controlled space and a multi-circuit cooling element in thermal communication with the temperature controlled space. The multi-circuit cooling element includes two or more cooling coils. Each of the cooling coils is coupled to a different circuit structured to selectively circulate coolant through the multi-circuit cooling element. Each circuit is fluidly separate from each remaining circuit such that the coolant circulated through each circuit is not shared with each remaining circuit. The multi-circuit cooling element further includes a plurality of heat exchange fins coupled to each of the two or more cooling coils such that each of the heat exchange fins facilitates heat removal from the temperature controlled space by each of the two or more cooling coils.

Another implementation of the present disclosure is a refrigeration system for a temperature controlled space. The refrigeration system includes a multi-circuit cooling element in thermal communication with the temperature controlled space. The multi-circuit cooling element includes a first cooling coil and a second cooling coil fluidly separate from the first cooling coil. The refrigeration system further includes a first circuit fluidly coupled to the first cooling coil and configured to circulate a first coolant through the first cooling coil to provide cooling for the temperature controlled space and a second circuit fluidly coupled to the second cooling coil and configured to circulate a second coolant through the second cooling coil to provide cooling for the temperature controlled space. The second circuit is fluidly separate from the first circuit such that the first coolant is not shared with the second circuit and the second coolant is not shared with the first circuit.

Another implementation of the present disclosure is another refrigeration system for a temperature controlled space. The refrigeration system includes a multi-circuit cooling element in thermal communication with the temperature controlled space. The multi-circuit cooling element includes a first cooling coil and a second cooling coil. The refrigeration system further includes a first circuit fluidly coupled to the first cooling coil and configured to circulate a coolant through the first cooling coil to provide cooling for the temperature controlled space and a second circuit fluidly coupled to the second cooling coil and configured to circulate the coolant through the second cooling coil to provide cooling for the temperature controlled space.

DETAILED DESCRIPTION

Figure 1:
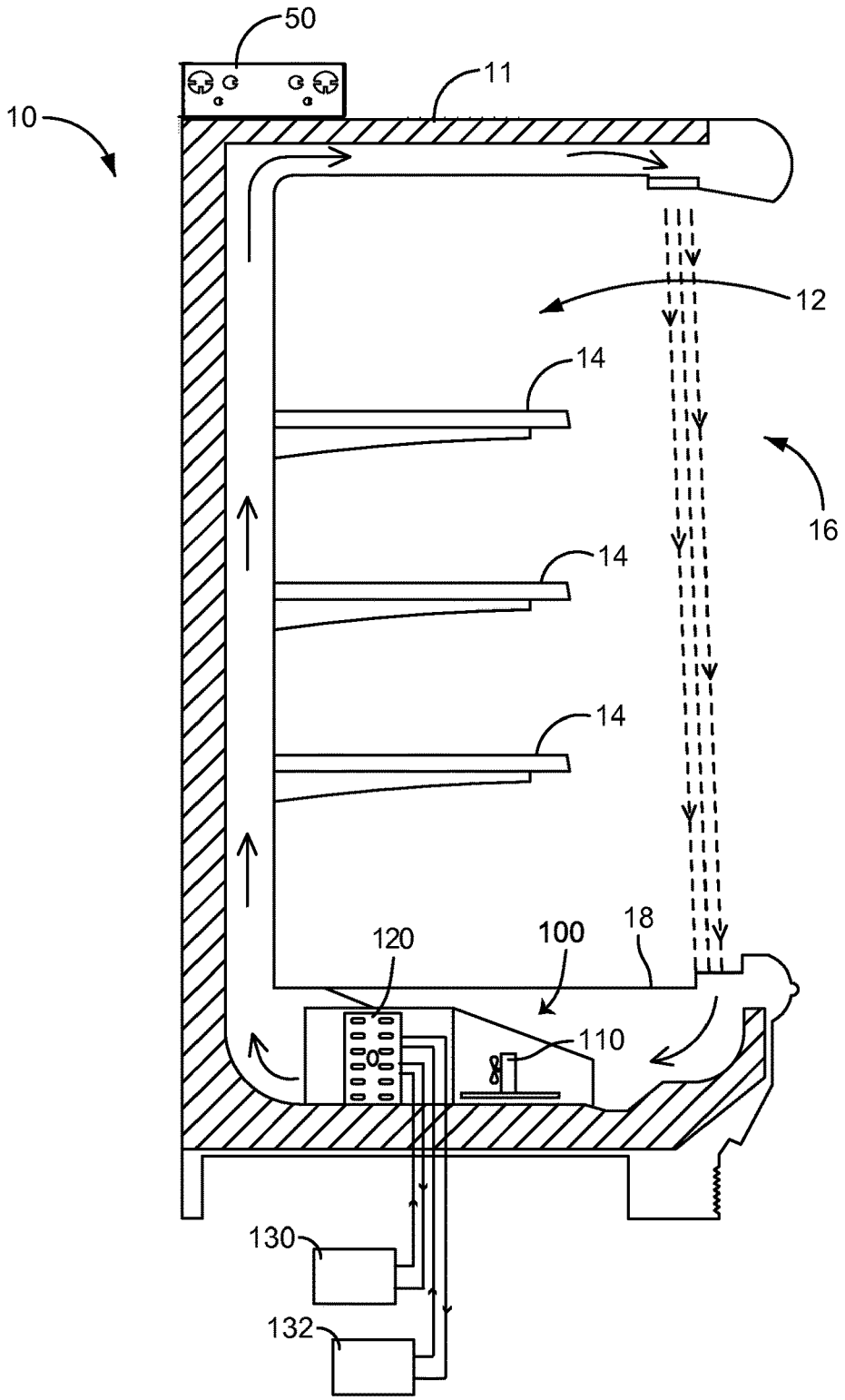
FIG. 1 is a side cross-sectional view of a vertically oriented temperature controlled case with cooling system having a multi-circuit cooling element, according to an exemplary embodiment.

In the following detailed description, reference is made to the accompanying drawings, which form a part thereof. In the drawings, similar symbols typically identify similar components, unless context dictates otherwise. The illustrative embodiments described in the detailed description, drawings, and claims are not meant to be limiting. Other embodiments may be utilized, and other changes may be made, without departing from the spirit or scope of the subject matter presented here.

Referring to the Figures generally, various embodiments disclosed herein relate to a multi-circuit cooling element for a refrigeration system for a temperature controlled display case. Temperature controlled display cases are often used to display and store products, such as food products (e.g., meat, dairy, seafood, etc.) and beverages. To maintain a temperature within the case, the temperature controlled display case may include a cooling or refrigeration system. The cooling system may include a cooling element (e.g. evaporator, cooling coil, fan-coil, evaporator coil, heat exchanger, etc.) that is used to maintain a desired storage/display temperature by absorbing heat from the temperature controlled space of the case. To absorb heat from the temperature controlled space, the cooling element circulates a refrigerant or coolant. The coolant may be flammable, such as a hydrocarbon coolant (e.g., propane), or low to non-flammable, such as a glycol-water mixture. In either configuration, based at least in part on the refrigeration load (e.g., the larger the size of the temperature controlled space, the likelier the higher the refrigeration load), the quantity of coolant used in an application may vary greatly. For example, relatively more coolant may be needed in a commercial setting (e.g., a supermarket comprising an aisle of interconnected temperature controlled cases) versus a residential setting. However, coolant is typically heavy and expensive. Further, coolant, both flammable and relatively low or non-flammable types, may be subject to one or more regulations that dictate the maximum amount/quantity of the coolant that may be used for a certain configuration. In particular, the maximum amount/quantity of coolant may be defined on a per circuit basis, where the "circuit" refers to one closed fluid loop for the coolant (e.g., from a condensing unit to an evaporator back to the condensing unit in a direct expansion system).

According to the present disclosure, a temperature controlled case includes a multi-circuit cooling element of a refrigeration or cooling system. In particular, the refrigeration system may include a single cooling element (e.g., evaporator, fan-coil unit) in fluid communication with two or more refrigeration circuits. The cooling element includes multiple fluid pathways (e.g., multiple cooling coils) that are fluidly isolated from each other yet contained within the same physical structure (i.e., within the cooling element). Each of the fluid pathways is coupled to a different refrigeration circuit and forms part of the corresponding refrigeration circuit. Each refrigeration circuit may be fluidly separate relative to each other refrigeration circuit such that the coolant circulated through each refrigeration circuit is not shared with each remaining refrigeration circuit. In this regard, each refrigeration circuit shares a common cooling element, yet includes its own set of dedicated components that form the remainder of the circuit (e.g., a condensing unit, one or more pumps, one or more valves, receivers, compressors, etc.). Although the cooling element is shared between the multiple refrigeration circuits, each refrigeration circuit may be fluidly coupled to a different fluid pathway within the cooling element such that coolant is not shared between any of the refrigeration circuits.

The use of two or more refrigeration circuits with a single cooling element may provide several benefits and advantages. One benefit includes the ability to selectively control the amount of cooling provided by the cooling element by utilizing less than all of the refrigeration circuits. Such a benefit may reduce energy consumption and better tailor the cooling provided by the cooling system to the intended circumstance/setting. Another benefit includes the ability to reduce a quantity of refrigerant used on a per circuit basis. Such an advantage may provide an ability to meet increasing regulations (e.g., Environment Protection Agency (EPA) regulations) that limit or reduce the amount of refrigerant that may be used per circuit. Beneficially, the multi-circuit cooling element refrigeration system may utilize relatively less refrigerant or coolant on a per circuit basis, yet still meet or substantially meet a desired load by utilizing multiple circuits. Furthermore, by utilizing relatively smaller amounts of refrigerant per circuit, the components (e.g., pumps, compressors, piping size, etc.) of each circuit may be relatively smaller than comparable components used in traditional cooling systems. Such a benefit may lead to cost savings and space savings. These and other features and benefits are described more fully herein below.

As used herein, the term "circuit" or "refrigeration circuit" refers to the piping (e.g., channels, conduits, passageways, flow paths, etc.) that form a closed-fluid loop for the refrigerant or coolant through a single cooling element (e.g., evaporator, etc.) in a cooling system of a temperature controlled case. Thus and as explained more fully herein, multiple "circuits" refer to multiple independent refrigerant or coolant loops through a single cooling element. It should be understood that while the examples shown and described herein illustrate only two circuits, such a depiction is for illustrative purposes only. Other embodiments may include any number of circuits without departing from the scope of the present disclosure.

Referring now to FIG. 1, a side cross-sectional view of a temperature controlled display device 10 with a multi-circuit cooling element is shown, according to an example embodiment. The temperature controlled display device 10 (also referred to as a "temperature controlled case") may be a refrigerator, a freezer, a refrigerated merchandiser, a refrigerated display case, or other device capable of use in a commercial, institutional, or residential setting for storing and/or displaying refrigerated or frozen objects. For example, the temperature controlled display device 10 may be a service type refrigerated display case for displaying fresh food products (e.g., beef, pork, poultry, fish, etc.) in a supermarket or other commercial setting. While the temperature controlled case 10 is shown as being vertically oriented, in other embodiments, the temperature controlled case may be horizontally oriented (e.g., where a door is substantially parallel to a ground or support surface for the case) or any other type of orientation for a temperature controlled case. Accordingly, the present disclosure may be applicable with any type of temperature controlled case.

The temperature controlled display device 10 is shown to include housing 11 defining a temperature controlled space 12 (i.e., a display area) having a plurality of shelves 14 for storage and display of products therein, a compartment 18, a box 50, and a cooling system 100. In various embodiments, the temperature controlled display device 10 may be an open-front refrigerated display case (as shown in FIG. 1) or a closed-front display case. An open-front display case may use a flow of chilled air that is discharged across the open front of the case (e.g., forming an air curtain 16) to help maintain a desired temperature within the temperature controlled space 12. In some embodiments of an open front display case, the air-curtain may be excluded. In comparison, a closed-front display case may include one or more doors for accessing food products or other items stored within temperature controlled space 12. Both types of display cases may also include various openings in communication with the temperature controlled space 12 that are configured to route chilled air from a cooling element, such as cooling element 120, to other portions of the respective display case 10 (e.g., via fan 110).

Figure 2:
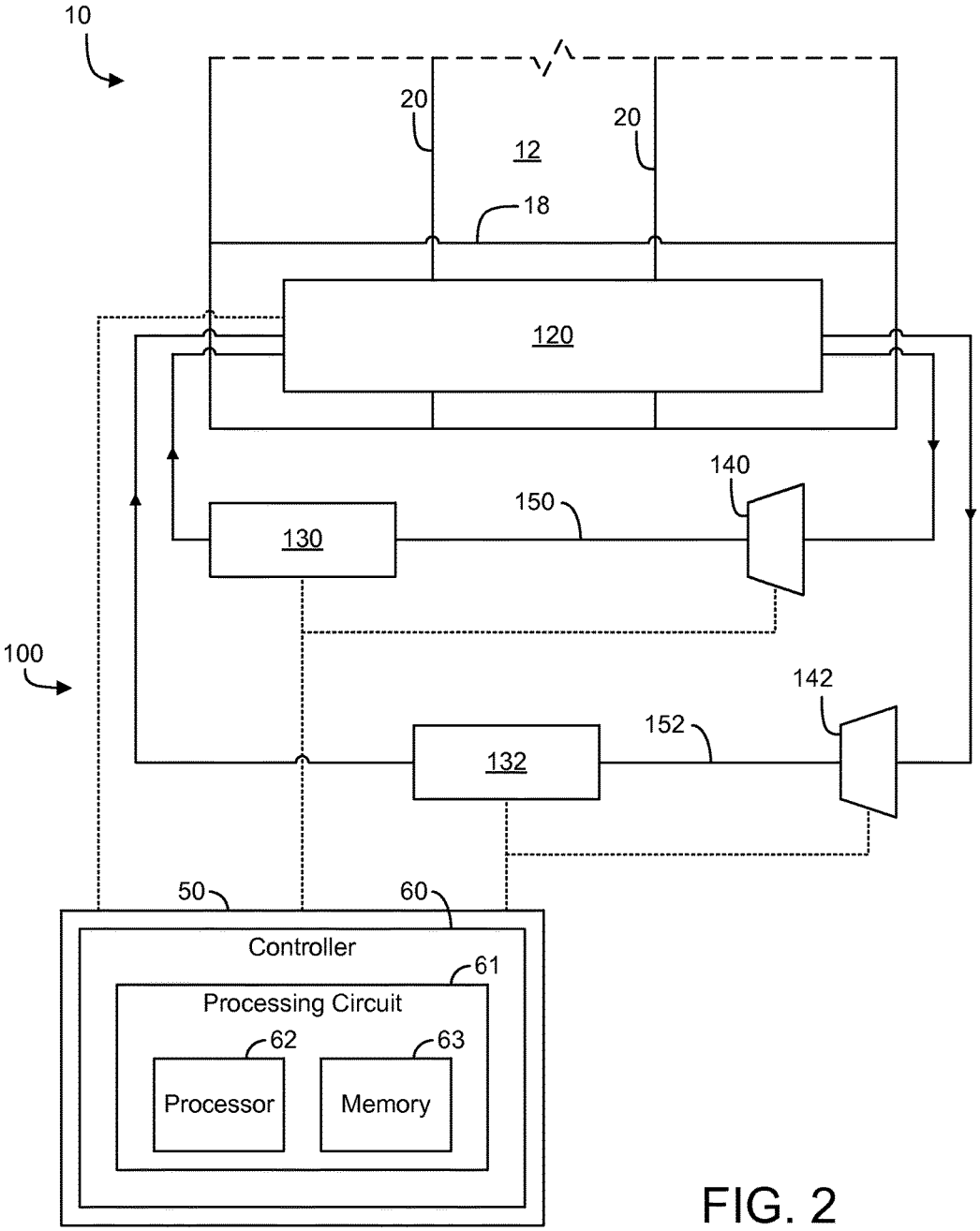
FIG. 2 is a schematic block diagram of a direct expansion cooling system with a multi-circuit cooling element for a temperature controlled case, according to an exemplary embodiment.
Figure 3:
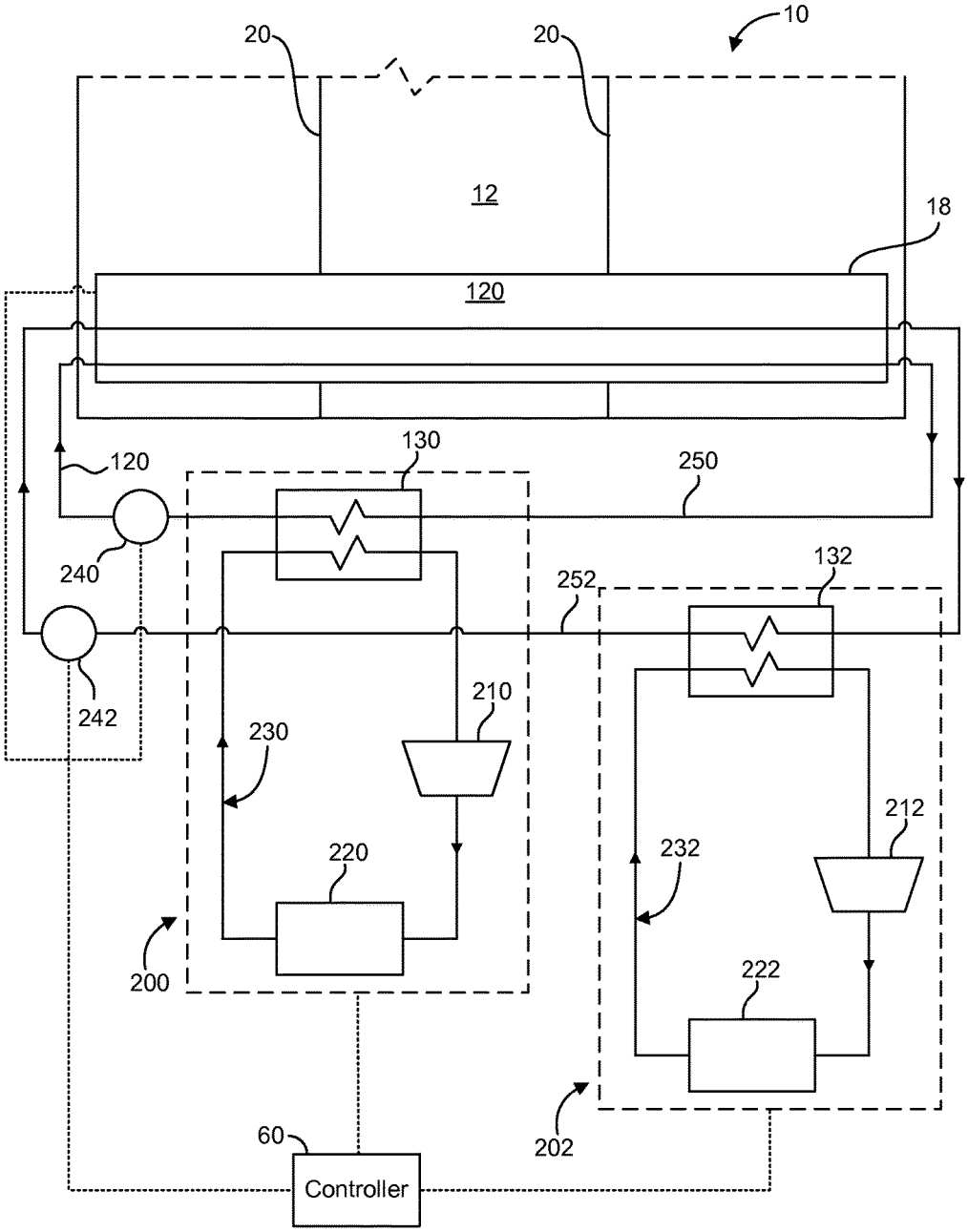
FIG. 3 is a schematic block diagram of a secondary coolant system with a multi-circuit cooling element for a temperature controlled case, according to an exemplary embodiment.
Figure 4:
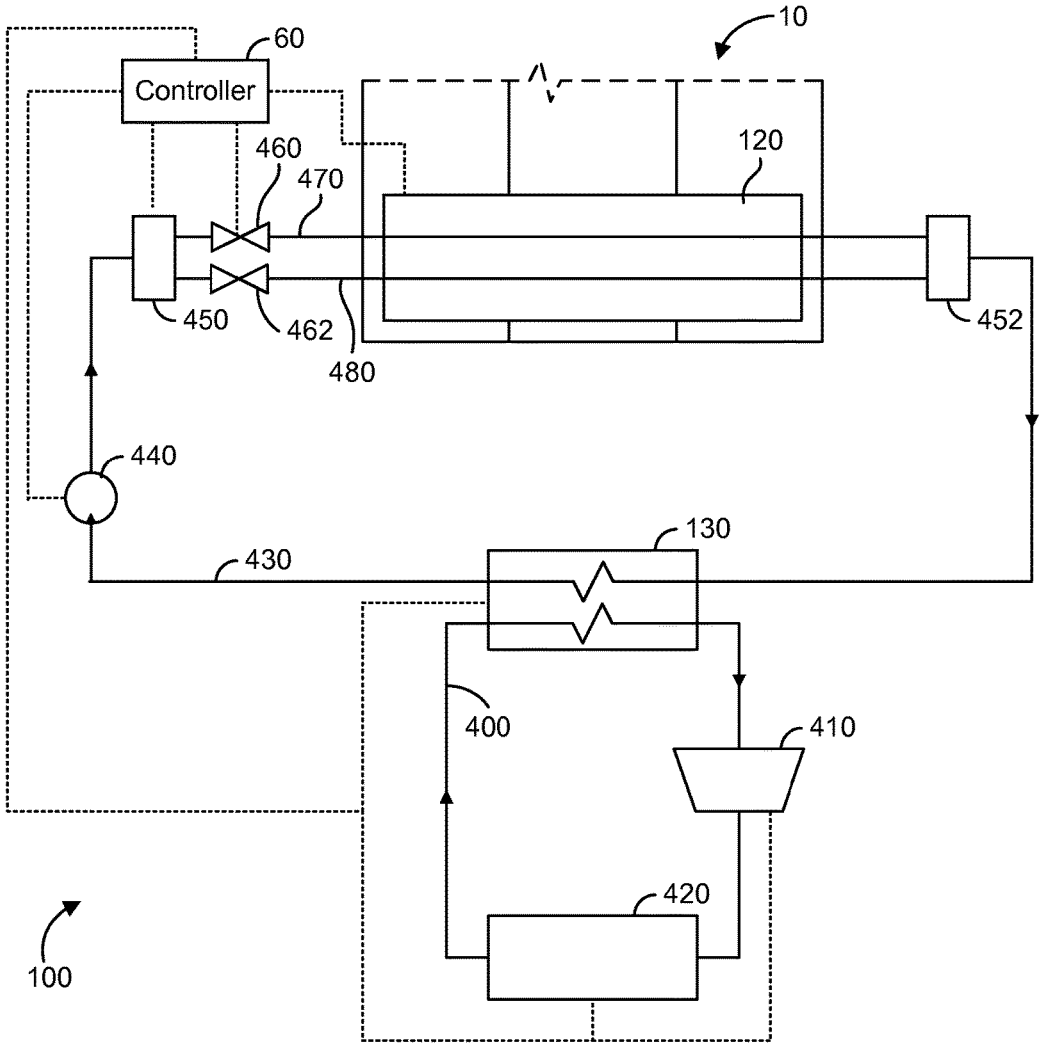
FIG. 4 is a schematic block diagram of another secondary coolant system with a multi-circuit cooling element for a temperature controlled case, according to an exemplary embodiment.

As mentioned above, the temperature controlled display device 10 includes a compartment 18 located beneath the temperature controlled space 12. In various other embodiments, the compartment 18 may be located behind the temperature controlled space 12, above the temperature controlled space 12, or otherwise located with respect to the temperature controlled space 12. All such variations are intended to fall within the spirit and scope of the present disclosure. The compartment 18 may function as a holding or storage space for containing components of the cooling system 100, such as the unit 130. Furthermore and in this regard, the cooling system 100 may include one or more components such as a separate compressor, an expansion device such as a valve or other pressure-regulating device, a temperature sensor, a controller (e.g., controller 60 as depicted in FIGS. 2-4), a fan, and/or other components commonly used in refrigeration systems, any of which may be stored within compartment 18.

As shown, the temperature controlled display device 10 may also include a box 50 for electronics (i.e., an "electronics box"). The electronics box 50 may be structured as a junction box for one or more electrically-driven components of the temperature controlled display device 10. The electronics box 50 may also be structured to store one or more controllers for one or more components of the device 10 (e.g., controller 60 in FIGS. 2-4). For example, the box 50 (and controller 60) may include hardware and/or logic components for selectively activating the cooling system 100 to achieve or substantially achieve a desired temperature in the temperature controlled display area 12.

As mentioned above, the temperature controlled display device 10 also includes a cooling system 100 for cooling the temperature controlled space 12. In one embodiment and as shown in FIG. 2, the cooling system 100 may be configured or structured as a direct expansion system. In other embodiments and as shown in FIGS. 3-4, the cooling system 100 may be configured or structured as a secondary coolant system. In yet another embodiment, the cooling system 100 may be structured as any other type of cooling system adapted to cool the temperature controlled space 12. All such variations are intended to fall within the spirit and scope of the present disclosure.

As shown, the cooling system 100 includes at least one fan 110 (or another air flower/mover device), a cooling element 120, and at least one unit, shown as a unit 130 and a unit 132. While different reference numbers are used to refer to the units 130, 132, this is done for clarity. Accordingly, in one embodiment, the units 130, 132 may have the same structure and function. In another embodiment, the units 130, 132 may have a different structure and function.

In either the direct expansion or the secondary coolant cooling system configuration, during a cooling mode of operation, the cooling element 120 may operate at a temperature lower than the temperature of the air within the temperature controlled space 12 to provide cooling to the temperature controlled space 12. For instance and in regard to a direct expansion system, during the cooling mode, the cooling element 120 may receive a liquid coolant from a condensing unit. The liquid coolant may lower the temperature of the cooling element 120 below the temperature of the air surrounding the cooling element 120 causing the cooling element 120 (e.g., the liquid coolant within cooling element 120) to absorb heat from the surrounding air. As the heat is removed from the surrounding air, the surrounding air is chilled. The chilled air may then be directed to the temperature controlled space 12 by at least one air mover or another air handling device, shown as a fan 110 in FIG. 1, in order to lower or otherwise control the temperature of the temperature controlled space 12.

As mentioned above, the cooling system 100 may be configured as a direct expansion system, a secondary coolant system, or any other heat exchange system. In this regard, the multi-circuit cooling element may be applicable with either a direct expansion system or a secondary coolant system. As such, the side cross-sectional view of the temperature controlled case 10 in FIG. 1 is intended to be generic to both configurations, while FIG. 2 depicts the temperature controlled case 10 with a direct expansion system and FIGS. 3-4 depict the temperature controlled case 10 with example secondary coolant systems. Accordingly, the cooling system 100 may be referred as the "direct expansion cooling system 100" when referring to FIG. 2 and either of the "secondary coolant cooling system 100 of FIG. 3," or the "secondary coolant cooling system 100 of FIG. 4" when referring to FIG. 3 or 4. Accordingly, further explanation of the multi-circuit cooling element in each cooling system configuration may be described in more detail herein in regard to FIGS. 2-4.

As such, referring now to FIG. 2, a multi-circuit cooling element for a direct expansion cooling system is schematically depicted according to an example embodiment. As shown in this front longitudinal view, the temperature controlled case 10 includes walls 20 (e.g., partitions, dividers, barriers, etc.), which may form a part of the housing 11 of the temperature controlled case 10, to divide the temperature controlled space 12 into various sections. In another embodiment, multiple temperature controlled cases 10 may be joined, coupled, connected, or otherwise linked together to form two or more separate or substantially thermally blocked temperature controlled spaces. In other embodiments, the linked or coupled together temperature controlled cases may form one or more combined temperature controlled spaces. All such variations are intended to fall within the scope of the present disclosure.

In the example depicted, the temperature controlled display device 10 includes a direct expansion cooling system 100 having a first refrigeration circuit 150 and a second refrigeration circuit 152. As shown and in this direct expansion cooling system 100, the first circuit 150 includes the cooling element 120, a unit 130, and a compressor 140, while the second circuit 152 includes the cooling element 120, a unit 132, and a compressor 142. Thus, the cooling element 120 is common or shared for each of the first and second circuits 140, 150. However, each circuit 150, 152 may include multiple inlet conduits (e.g., channels, pipes, etc.) and multiple outlet conduits (e.g., channels, pipes, etc.), like as shown and described herein in regard to the example routing or piping configuration for the cooling element 120 in FIGS. 5A-5C. The compressors 140, 142 may be structured as any type of compressor used in refrigeration systems, such as a reciprocating compressor, rotary screw compressor, centrifugal compressor, and so on. Further, more than one compressor may be included in each circuit 150, 152. In this regard, other components such as valves and pumps may be included in one or both of the first and second circuits 150 and 152, such that the schematic depiction of components in FIG. 2 is not meant to be limiting. In the direct expansion cooling system 100 configuration of FIG. 2, the units 130, 132 may be structured as a condensing unit or parallel condensing system. As such and when referring to FIG. 2, the units 130, 132 may be referred as "condensing units" or "condensers." As mentioned above, it should be understood that in other embodiments, more than two refrigeration circuits may be used with a common cooling element (e.g., three, four, five, etc. circuits), with all such variations intended to fall within the spirit and scope of the present disclosure.

The first and second circuits 150, 152 may include cooling coils that circulate a coolant or refrigerant through the cooling element 120. The coolant or refrigerant may be any type of coolant or refrigerant used in direct expansion cooling system. For example, the coolant or refrigerant may include a flammable type refrigerant, such as propane. In another example, the coolant or refrigerant may include a non-flammable type refrigerant. All such variations are intended to fall within the scope of the present disclosure.

As shown, the temperature controlled display device may also include a controller 60 communicably and operatively coupled to one or more components of the temperature controlled case 10 and of the first and second circuits 150, 152. The controller 60 may be structured to receive information (e.g., data, values, etc.) regarding operation of one or more components and control one or more components responsive to that information. In this regard, the controller 60 is shown to include a processing circuit 61 including a processor 62 and a memory 63. The processor 62 may be implemented as a general-purpose processor, an application specific integrated circuit (ASIC), one or more field programmable gate arrays (FPGAs), a digital signal processor (DSP), a group of processing components, or other suitable electronic processing components. The one or more memory devices 63 (e.g., NVRAM, RAM, ROM, Flash Memory, hard disk storage, etc.) may store data and/or computer code for facilitating the various processes described herein. Thus, the one or more memory devices 63 may be communicably connected to the processor 62 and provide computer code or instructions to the processor 62 for executing various processes described herein. Moreover, the one or more memory devices 63 may be or include tangible, non-transient volatile memory or non-volatile memory. Accordingly, the one or more memory devices 63 may include database components, object code components, script components, or any other type of information structure for supporting the various activities and information structures described herein.

As shown, the controller 60 may be included with the electronics box 50. However, in other embodiments, the controller 60 may be a separate component relative to the temperature controlled case 10 (e.g., a remote controller 60 that may be held and handled by an attendant of the temperature controlled case 10). Accordingly, communication between and among the components of FIG. 2 (and FIGS. 3-4) may be via any number of wired or wireless connections (e.g., any standard under IEEE 802, etc.). For example, a wired connection may include a serial cable, a fiber optic cable, a CATS cable, or any other form of wired connection. In comparison, a wireless connection may include the Internet, Wi-Fi, cellular, Bluetooth, ZigBee, radio, etc. In one embodiment, a controller area network (CAN) bus provides the exchange of signals, information, and/or data. The CAN bus can include any number of wired and wireless connections that provide the exchange of signals, information, and/or data. The CAN bus may include a local area network (LAN), or a wide area network (WAN), or the connection may be made to an external computer (for example, through the Internet using an Internet Service Provider). As described herein below, the controller 60 may be structured to control which circuit is active (i.e., circulating coolant) during operation of the temperature controlled case 10.

In the example depicted, the cooling element 120 is sized and structured to be in thermal communication with temperature controlled space 12 to remove heat and cool the space 12 to a desired temperature. Accordingly and as shown, a single cooling element 120 may be utilized with the temperature controlled case 10. In this regard and in one embodiment, a single cooling element 120 may be utilized with multiple assembled multiple temperature controlled cases (e.g., in a supermarket setting where the multiple assembled cases extend a length of an aisle). In this configuration and before installation of multiple adjoined temperature controlled cases, a determination may be made as to the combined length of the cases to define the length needed or substantially needed for the cooling element 120. However and according to an alternate embodiment, each temperature controlled case 10 may include a separate cooling element 120, where each cooling element 120 of each temperature controlled case 10 may include two or more circuits. Thus, those of ordinary skill in the art will appreciate the configurability of the cooling element 120 relative to the temperature controlled case 10 of the present disclosure, with all such variations intended to fall within the scope of the present disclosure.

Based on the foregoing, operation of the multi-circuit cooling element 120 of the direct expansion cooling system 100 may be explained as follows. The first and second circuits 150, 152 may be selectively and separately operable and may be controlled by the controller 60 or by multiple controllers (e.g., one controller for the first circuit 150 and another controller for the second circuit 152). In a first operation mode, coolant or refrigerant may only be circulated in one of the first and second circuits 150, 152. For example, the controller 60 may activate the compressor 140 and open a valve in the first circuit 150 to cause circulation of coolant in the first circuit 150 while simultaneously deactivating the compressor 142 and close a valve in the second circuit 152 to prevent or substantially prevent circulation of coolant in the second circuit 152. In comparison and in a second operation mode, coolant or refrigerant may be pumped or circulated through both of the first and second circuits 150, 152 simultaneously. As an example of the first operation mode, if a lower refrigeration load is expected or desired (e.g., a relatively warmer temperature controlled space 12 is desired), then only one of the first and second circuits 150, 152 may be utilized (i.e., the first operation mode). For example, the controller 60 may activate the compressor 142 to cause coolant circulation in the second circuit 152 while keep the compressor 140 deactivated to prevent or substantially prevent coolant circulation in the first circuit 150.

In another embodiment and because the cooling element 120 may be sized and structured to fit a particular multiple or single temperature case arrangement, the cooling element 120 may be constructed to accommodate two or more circuits, yet only be installed with one circuit (e.g., in the example of FIG. 2, only the first circuit 150 may be installed), such that only one circuit is operable initially. However, at some time in the future when the refrigeration load is expected to be higher, rather than install a new temperature controlled case, additional circuit(s) may be installed or implemented with the existing cooling element. Thus, the multi-circuit cooling element 120 of the present disclosure may be scalable with respect to the cooling element based on the desired cooling for a particular volume or space.

Beneficially, while the total amount or quantity of refrigerant may stay relatively constant between the multi-circuit cooling element configuration and a cooling element that utilizes only one circuit, the per-circuit quantity may be considerably or relatively less. Such a characteristic of the multi-circuit cooling element may facilitate compliance or substantial compliance with one or more regulations that prescribe a maximum refrigerant amount per circuit. Further, multi-circuit cooling element 120 may enable and provide control over the cooling delivered by the cooling element 120. For example, if more cooling is desired, an attendant may cause the controller 60 to activate all or mostly all of the circuits in the cooling element. However, if relatively less cooling is desired, an attendant may provide an instruction to the controller 60 to deactivate at least one of the circuits in the cooling element.

In addition to these benefits, the multi-circuit cooling element may also ease maintenance to reduce downtime of the temperature controlled display device. For example, because relatively less piping may be used per circuit due to a circuit potentially being relatively smaller or shorter in length than a comparable one-circuit design, a technician may reduce an area that must be leak-checked. Further, the technician may leak-check only one circuit at a time to thereby keep the other circuit(s) operational and the temperature controlled space 12 cooled, which minimizes downtime of the temperature controlled display device 10.

As mentioned above, the multi-circuit cooling element may be utilized in direct expansion, secondary coolant, and any other cooling system used with a temperature controlled display device. In this regard and referring now to FIGS. 3-4, schematic block diagrams multi-circuit cooling elements for secondary coolant systems are shown, according to example embodiments. For clarity, the cooling system of FIG. 3 is referred to herein as the "secondary coolant cooling system 100 of FIG. 3" while the cooling system of FIG. 4 is referred to herein as the "secondary coolant cooling system 100 of FIG. 4."

In some situations/settings (e.g., supermarkets), a secondary coolant system configuration may be advantageous over a direct expansion system due to relatively less refrigerant or coolant being needed, relatively lesser leak possibilities, and in turn a potential for improved maintenance (e.g. an ease of troubleshooting or other maintenance). Such benefits may be due, at least in part, by the positioning of a relatively greater amount of the refrigerant in a primary refrigerant loop, which may be physically separate relative to a secondary coolant loop that is in communication with a cooling element and temperature controlled case. In this regard, technicians may have relatively better access to the components containing the bulk of the refrigerant, which may facilitate easier maintenance and troubleshooting.

Referring first to FIG. 3 and similar to FIG. 2, the temperature controlled case 10 may include walls 20 (e.g., partitions, dividers, barriers, etc.), which may form a part of the housing 11 of the temperature controlled case 10, to divide the temperature controlled space 12 into various sections. In another embodiment, multiple temperature controlled cases 10 may be joined, coupled, connected, or otherwise linked together to form two or more separate or substantially thermally blocked temperature controlled spaces. In each embodiment and similar to the direct expansion system of FIG. 2, a single cooling element 120 may be utilized with one or more of the temperature controlled cases 10.

Relative to the direct expansion systems of FIG. 2, the temperature controlled case 10 includes a secondary coolant cooling system 100 of FIG. 3. The secondary coolant cooling system 100 of FIG. 3 utilizes a common cooling element 120 with two "chiller packages." A first part of the secondary coolant cooling system 100 of FIG. 3 includes the cooling element 120, a first secondary circuit 230, and a first chiller package 200. A second part of the secondary coolant cooling system 100 of FIG. 3 includes the cooling element 120, a second secondary circuit 232, and a second chiller package 202. The shared cooling element 120 may provide modularity with respect to remaining components of secondary coolant cooling system 100 of FIG. 3. For example, after installation of a first chiller package (e.g., chiller package 200) with the cooling element 120, due to the cooling element 120 being constructed to accommodate additional coils of a different circuit in a future time, the second chiller package 202 may be installed at a later date to, e.g., adjust the available cooling provided to the temperature controlled display case 10.

The "chiller package" refers to the components that form or construct the primary refrigerant or coolant loop in a secondary coolant system. Accordingly, the first chiller package 200 includes a unit 130, a compressor 210, and a condenser 220 (e.g., condensing unit), which collectively form a first primary refrigerant loop or circuit 230. In comparison, the second chiller package 202 includes the unit 132, a compressor 212, and condenser 222 (e.g., condensing unit), which collectively form a second primary refrigerant loop or circuit 232. While different reference numbers are used, the compressors 210, 212 may have the same configuration as the compressors 140, 142 of FIG. 2. In this regard, the compressors 210, 212 may have any structure useable in a secondary coolant system. Similarly, the condensers 220, 222 may have the same configuration as the condensers 130, 132 in FIG. 2. Accordingly, the condensers 220, 222 may have any structure that may be used with a secondary coolant system. However and relative to the condensers 130, 132 of FIG. 2, the first and second units 130, 132 are structured as chillers (e.g., heat exchangers) in the configuration of FIG. 3. Accordingly, the first and second units 130, 132 may be referred to as first and second chillers 130, 132 when referring to the units 130, 132 in FIG. 3 (and in FIG. 4). It should be understood that the components depicted in the first and second primary refrigerant loops 230, 232 are not meant to be limiting. Various other components that may typically be utilized with primary refrigerant loops may also be included in the loops 230, 232 without departing from the scope of the present disclosure (e.g., valves, receivers, pumps, temperature sensors, pressure sensors, etc.).

As shown, the first chiller 130 is in fluid communication with a first pump 240 and the cooling element 120 to collectively form a first secondary coolant circuit 250. In comparison, the second chiller 132 is in fluid communication with a second pump 242 and the cooling element 120 to collectively form a second secondary coolant circuit 252. The pumps 240, 242 may have any type of pump configuration that may be utilized in secondary coolant systems. For example, the pump configuration may include, but is not limited to, positive displacement, centrifugal, etc. While different reference numbers are used, in one embodiment, the pumps 240, 242 may have the same structure and function. In another embodiment, the pumps 240, 242 may have a different structure.

The primary refrigerant circulated in the primary refrigerant loops 230, 232 may include any type of refrigerant used in primary refrigerant loops of secondary coolant systems. Accordingly, the primary refrigerant may include, but is not limited to, a phase change refrigerant, such as a propane-based refrigerant. In comparison, the coolant circulated in the first and second circuits 250, 252 may include any type of coolant useable in a secondary coolant loop of a secondary coolant system. For example, the secondary coolant may include, but is not limited to, a phase change refrigerant and, in most applications, a single phase coolant, such as a propylene glycol/water mix.

Similar to the multi-circuit cooling element of FIG. 2, as shown, the cooling element 120 includes a first circuit 250 and a second circuit 252. Further, the cooling element 120 is sized to be in thermal communication with the temperature controlled space 12 of the temperature controlled case 10. In this regard, a single cooling element 120 is utilized with the temperature controlled case 10. Accordingly, in certain embodiments, a single cooling element, such as cooling element 120, may be utilized with multiple adjoined temperature controlled cases. In other alternate embodiments, multiple cooling elements may be used with each temperature controlled case in a multiple adjoined temperature controlled case configuration.

With the above in mind, operation of the secondary coolant cooling system 100 of FIG. 3 may be described as follows. The first and second primary refrigerant loops 230, 232 may circulate a primary refrigerant. For example and in regard to the first primary refrigerant loop 230, the primary refrigerant may be circulated through the first chiller 130 to the compressor 210 to the condenser 220 and back to the chiller 130, where the cycle may then repeats. The first and second chillers 130, 132 enable and provide a heat exchanging relationship between the primary refrigerant in the first and second primary refrigerant loops 230, 232 and the secondary coolant circulated in the first and second circuits 250, 252, respectively. With reference to only the first primary refrigerant loop 230 and first circuit 250, the primary refrigerant is circulated to the first chiller 130, where the primary refrigerant exits as a superheated vapor and returns to the compressor 210, where the superheated vapor primary refrigerant is compressed. The compressed refrigerant is then circulated to the condenser 220, which condenses the primary refrigerant to a liquid state where the liquid primary refrigerant is then provided to one side of the first chiller 130. On the other side of the first chiller 130, the secondary coolant is circulated, such that the secondary coolant in the first secondary circuit 250 exchanges heat with the liquid primary refrigerant from the first primary refrigerant circuit 230. Due to this heat exchange, the secondary coolant in the first circuit 250 experiences a reduction in temperature to cause the removal of heat from the secondary coolant in the first chiller 130. The secondary coolant is then circulated, by the pump 240, to the cooling element 120, where the secondary coolant absorbs heat from the temperature controlled space 12 to maintain or substantially maintain a refrigeration or freezing temperature for the temperature controlled space 12. A similar process is implemented with the second circuit 252 and the second primary refrigerant circuit 232.

Relative to conventional secondary coolant systems, however, the multi-circuit cooling element 120 may selectively circulate secondary coolant through one or both of the first and second circuits 250, 252 in the cooling element 120. Accordingly and like described above in regard to FIG. 2, the controller 60 may selectively activate one or both the first and second circuits 250, 252 by sending activation instructions to various components included in the first and second circuits 250, 252 as well as the chiller packages 200, 202. For example, when a refrigeration load is expected to be relatively low, the controller 60 may only activate the first chiller 200 by providing a command to activate the compressor 210 and selectively open/close any valves included in the first primary refrigerant loop 230. Simultaneously or near simultaneously, the controller 60 may provide a command to activate the pump 240 and selectively open/close any valves in the first circuit 250 to cause circulation of the secondary coolant in the first circuit 250. Based on these processes, the first circuit 250 is only active in the multi-circuit cooling element 120 (i.e., the first operation mode). However, using similar processes, the controller 60 may selectively activate the second chiller package 202 and second circuit 252 responsive to data indicative a higher refrigeration load above a predetermined threshold or an instruction provided by an attendant of the temperature controlled case 10 (i.e., the second operation mode).

Beneficially, the secondary coolant cooling system 100 of FIG. 3 enables modularity with respect to the chiller packages 200, 202. For example, a manufacturer may construct default chiller packages and multi-circuit cooling elements, where the multi-circuit cooling elements may contain two or more circuits. Accordingly, the cooling system may be scalable to accommodate as many chiller packages as circuits included the multi-circuit cooling element 120 (e.g., a maximum of three chiller packages may be used with a three circuit cooling element which can also accommodate one or two only chiller packages, etc.). This may enable buyers/implementation engineers to better scale their system with an expected refrigeration load.

Also beneficially, a quantity of primary refrigerant may be relatively lower compared to conventional secondary coolant cooling systems. Because FIG. 3 utilizes two or more chiller packages that each circulate primary refrigerant, the total primary refrigerant for a comparable secondary coolant system may stay substantially the same, however, the total amount of primary refrigerant is now divided up by the number of chiller packages. In this regard, the primary refrigerant used in the primary refrigerant loops (e.g., loops 230, 232) is relatively less as compared to conventional secondary coolant systems. Similarly, the secondary coolant circulated in the circuits 250, 252 may also be comparably smaller relative to the quantity of secondary coolant in conventional secondary coolant loops. Thus, and as mentioned above, the relative sizes of the components (e.g., piping, compressors, pumps, etc.) may be smaller than the sizes of the components used in conventional secondary coolant cooling systems. Consequently, a cost-savings and a space-savings benefit may be experienced by those utilizing the multi-circuit cooling element 120.

Referring now to FIG. 4, a schematic block diagram of another secondary coolant system for a temperature controlled case with a multi-circuit cooling element, according to an exemplary embodiment. Relative to the secondary coolant system of FIG. 3, the secondary coolant system 100 of FIG. 4 does not utilize two or more chiller packages.

In this embodiment and as shown, the temperature controlled case 10 includes a secondary coolant system 100 having a primary refrigerant circuit 400 (e.g., primary refrigerant loop, etc.). The primary refrigerant circuit 400 may include a chiller 130, a compressor 410, and a condenser 420. Similar to FIG. 3, the components depicted in the primary refrigerant circuit 400 are not meant to be limiting as other embodiments may include more, different, or fewer components with departing from the scope of the present disclosure (e.g., one or more valves, etc.).

The primary refrigerant circuit 400 may be structured to circulate a primary refrigerant. The primary refrigerant may have the same configuration as described above in regard to FIG. 3. Further, the chiller 130, compressor 410, and condenser 420 may have the same or similar configurations to the analogous components shown and described herein in regard to FIG. 3.

In a heat exchanging relationship with the primary refrigerant loop 400 through the chiller 130 is a secondary coolant loop 430. The secondary coolant loop 430 may circulate a secondary coolant, wherein the secondary coolant may have the same or substantially the same structure as the secondary coolant described herein above in FIG. 3. The secondary coolant loop 430 is shown to include the chiller 130 in fluid communication with a pump 440, a header 450 in fluid receiving communication with the pump 440, the multi-circuit cooling element 120 in fluid receiving communication with the header 450, and another header 452 structured to receive the fluid circulated through the multi-circuit cooling element 120 and provide that coolant back to the chiller 130.

The pump 440 may be structured like any of the pumps described herein (e.g., pump 240 of FIG. 3), and may be configured to selectively pump the secondary coolant to a header 450 (e.g., inlet manifold, etc.). The header 450 may define a receiving volume for the secondary coolant from the pump 440, and as such, may be referred to as the "inlet header 450." In comparison, the header 452 may define a receiving volume from the secondary coolant from the cooling element 120, and as such, may be referred to as the "outlet header 452." Each of the inlet and outlet headers 450, 452 may be in fluid communication with a first circuit 470 and a second circuit 480 that comprise the multi-circuit cooling element 120. In this regard and to accommodate fluid coupling to the first and second circuits 470, 480, the inlet and outlet headers 450, 452 (e.g., manifolds, etc.) may have any shape and size (e.g., rectangular prism, cylindrical etc.). Further, the inlet and outlet headers 450, 452 may include one or more fittings that facilitate coupling and uncoupling to the first and second circuits 470, 480. Thus, those of ordinary skill in the art will appreciate the high configurability of the headers 450, 452, with all such variations intended to fall within the scope of the present disclosure.

As also shown, a first valve 460 of the first circuit 470 is disposed between the inlet header 450 and the cooling element 120, while a second valve 462 of the second circuit 480 is disposed between the inlet header 450 and the cooling element 120. While the valves 460, 462 have different reference numbers, this is done for clarity. Accordingly, in one embodiment, the valves 460, 462 may have the same structure and function. However, in an alternate embodiment, the valves 460, 462 may have a different structure. The valves 460, 462 may be movable between an open position and a closed position to selectively allow secondary coolant to flow through the first and second circuits 470, 480, respectively. Accordingly, the valves 460, 462 may have any type of valve configuration for selectively allowing fluid flow. For example, the valves 460, 462 may include, but are not limited to, butterfly valves, ball valves, solenoid actuated valves, and so on.

With the above description in mind, operation of the secondary coolant cooling system 100 of FIG. 4 may be described as follows. The controller 60 may provide a command (e.g., instruction, etc.) to one or more components in the primary refrigerant loop 400 (e.g., compressor 410) to begin circulation of the primary refrigerant loop. Simultaneously, the controller 60 may provide a command (e.g., instruction) to cause circulation of the secondary coolant in the secondary coolant loop 430. The secondary coolant may experience a reduction in temperature as heat is removed from the secondary coolant through the heat exchange exchanging relationship with the primary refrigerant loop 400 in the chiller 130. The cooled secondary coolant may then be provided to the pump 440, where the pump 440 pumps, guides, or directs the cooled secondary coolant to the inlet manifold 450.

At this point, the controller 60 may selectively cause activation of one or both of the first and second circuits 470, 480 in a similar manner as described herein in regard to FIGS. 2-3. If a relatively lower cooling load is determined to be needed, the controller 60 may close one of the valves 460, 462 and open the remaining the valve 460, 462 to cause the secondary coolant to flow through only one of the circuits 470, 480 (i.e., the first mode of operation). However, if cooling above a threshold is needed or may be needed (e.g., above a predefined load threshold), the controller 60 may open both valves 460, 462 to cause secondary coolant to flow through each of the circuits 470, 480 of the cooling element 120. Thus, the cooling provided by the cooling element 120 may be configurable based on a determined, expected, or desired level of cooling from the cooling element 120.

As the secondary coolant flows through the cooling element, the secondary coolant absorbs heat from the temperature controlled space 12. The heated secondary coolant is received by the outlet header 452 and provided to the chiller 130, where the secondary coolant releases at least some of the heat absorbed to the primary refrigerant. At which point, the cycle may repeat itself.

Based on the foregoing, the secondary coolant cooling system 100 of FIG. 4 may have the same or similar advantages and benefits as described herein. For example, the two circuits 470, 480 may limit the total amount of coolant in the coils comprising each circuit relative to conventional cooling elements. Accordingly, the relatively lower quantity of coolant may facilitate meeting or substantially meeting regulations that require using lesser amounts of refrigerant. Further, the ability to selectively activate and deactivate the circuits in the cooling element 120 may facilitate a reduction in energy consumption through better matching of the circulated coolant to the anticipated load.

As mentioned above, each circuit of the cooling element 120 may include multiple inlets and outlets that form or comprise one or more cooling coils in the cooling element 120. In this regard, the piping or routing configuration of each circuit in the cooling element 120 is highly variable.

Figure 5A:
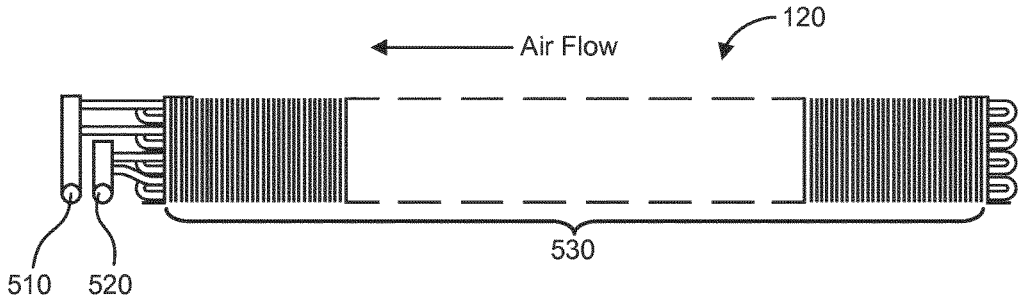
FIG. 5A is a front longitudinal view of a multi-circuit cooling element for a temperature controlled case, according to an exemplary embodiment.
Figure 5B:
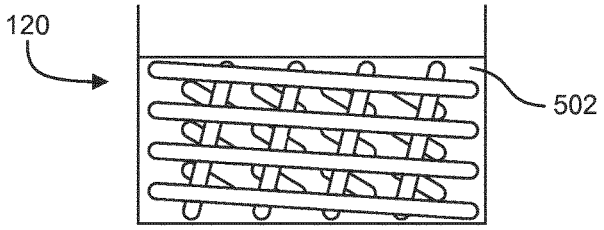
FIG. 5B is a left side view of the multi-circuit cooling element of FIG. 5A, according to an exemplary embodiment.
Figure 5C:
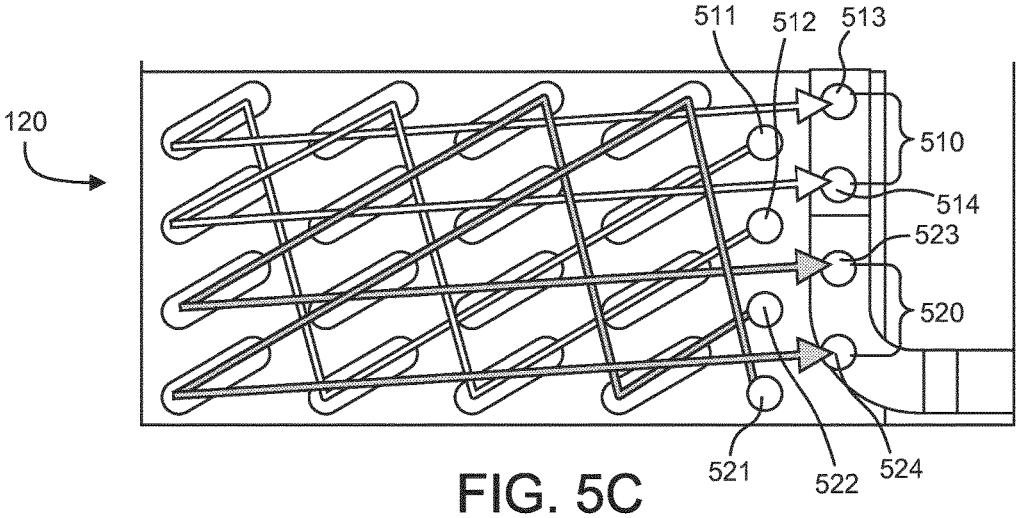
FIG. 5C is a right side view of the multi-circuit cooling element of FIG. 5A, according to an exemplary embodiment.

For illustrative purposes and referring now to FIGS. 5A-5C, an example piping for the cooling element 120 is shown, according to various an example embodiments. FIG. 5A depicts a front longitudinal view of the cooling element 120, FIG. 5B depicts a right hand side view of the cooling element 120 (based on the viewpoint of FIG. 5A), while FIG. 5C depicts a left hand side view of the cooling element 120 (based on the viewpoint of the cooling element 120 in FIG. 5A). In the example depicted, the cooling element 120 includes two circuits, shown as a first circuit 510 and a second circuit 520, such that the cooling element 120 may be applicable in any of the cooling systems depicted in FIGS. 2-4.

As shown in FIGS. 5A-5C, the cooling element 120 includes a plurality of heat exchange fins 502 coupled to cooling coils (e.g., an evaporator coil, etc.) to form a fin-coil or fan-coil unit. The fins 502 (e.g., plates, etc.) may be constructed from any material (e.g., metal) and be of any shape and size (e.g., square plates) to facilitate heat removal. In some embodiments, the fins 502 are substantially parallel to each other and separated from each other by a predetermined distance along a length of the cooling coils. The fins 502 define a plurality of holes (e.g., gaps, voids, openings, etc.) that receive coils (e.g., pipes, channels, passageways, conduits, etc.) of each of the first and second circuits 510, 520. In some embodiments, each of the fins 502 is thermally coupled to each of the cooling coils of the first and second circuits 510, 520 such that each of the fins 502 can facilitate heat removal from the temperature controlled space 12 by either or both of the first and second circuits 510, 520.

In this regard and as mentioned above, each circuit 510, 520 may have or include multiple inlets and outlets relative to the cooling element 120 that form, construct, or comprise the cooling coils of each circuit 510, 520. In this regard, coolant or refrigerant may be circulated through the cooling coils of each circuit 510, 520. In this example, the first circuit 510 includes a first inlet 511 of a first coil of the first circuit 510, a second inlet 512 of a second coil of the first circuit 510, a first outlet 513 of the first coil of the first circuit 510, and a first outlet 514 of the second coil of the first circuit 510. In comparison, the second circuit 520 includes a first inlet 521 of a first coil of the second circuit 520, a second inlet 522 of a second coil of the second circuit 520, a first outlet 523 of the first coil of the second circuit 520, and a first outlet 524 of the second coil of the second circuit 520. With reference to FIG. 5C in particular, an example routing or piping configuration of the first and second coils of each circuit 510, 520 in the cooling element 120 are shown according to an example embodiment. In this depiction, the coils of each circuit 510, 520 overlap. However, in other embodiments, any other type of routing or piping configuration may be used with all such variations intended to fall within the scope of the present disclosure. Further, other embodiments may utilize more than two coils per circuit or only one coil per circuit, with all such variations intended to fall within the scope of the present disclosure.

As shown in this example embodiment, the inlets to and outlets from the cooling element 120 of the circuits 510 and 520 are positioned or disposed on the left hand side of the cooling element 120. In this regard and relative to the direction of the air flow (see FIG. 5A), the air flow travels from the right side to the left side of the cooling element 120. However, in other embodiments, at least one of the inlets and outlets may be disposed on a different side of the cooling element 120 relative to the remaining inlets and outlets.

As mentioned above, the cooling element 120 may be sized and structured for the temperature controlled case 10 or adjoined multiple temperature controlled cases. The ability of the cooling element 120 to be constructed in multiple lengths to accommodate the length of the temperature controlled case(s) 10 is shown by length 530 in FIG. 5A. In some embodiments, the length 530 of the cooling element 120 is approximately 81 inches. However, it should be understood that the length 530 of the cooling element 120 may be highly configurable to accommodate multiple different applications.

In some embodiments, the fins 502 have a height (up and down in FIGS. 5A-5B) of approximately 5 inches, a length (left and right in FIG. 5A) of approximately 81 inches, and a width (left and right in FIGS. 5B-5C) of approximately 10.77 inches. The coils may have a height of approximately 5.25 inches and a length of approximately 83.5 inches. The cooling element 120 may have an overall width of approximately $10^{29}/_{32}$ inches. In some embodiments the lengthwise distance from the left end of circuit 520 to the left end of the fins 502 is approximately 3.5 inches, whereas the lengthwise distance from the left end of circuit 510 to the left end of the fins 502 is approximately 5 inches. However, it should be understood that these dimensions may be highly configurable to accommodate multiple different applications.

In some embodiments, the cooling element 120 includes flanges that extend lengthwise (left and right in FIG. 5A) from the left side and right side of the fins 502 above and below the coils. The flanges may have a length of approximately 1.25 inches to cover the ends of the coils that extend beyond the fins 502. However, it should be understood that these dimensions may be highly configurable to accommodate multiple different applications.

It should be understood that many different types of piping or routing configurations for each circuit may be implemented with the cooling element 120 with all such variations intended to fall within the scope of the present disclosure. Further, it should also be understood that in other embodiments, the cooling element 120 may include more than two circuits with each circuit having one or more coils. Moreover, the size and shape of the cooling element 120 may differ from what is depicted. Accordingly, those of ordinary skill in the art will recognize and appreciate the wide range of configurability provided by the cooling element 120 of the present disclosure.

It should be noted that references to "front," "rear," "upper," and "lower" in this description are merely used to identify the various elements as they are oriented in the Figures, with "front" and "rear" being relative the positioning of the temperature controlled case in which the multi-circuit cooling element is used. These terms are not meant to limit the element which they describe, as the various elements may be oriented differently in various temperature controlled cases.

Further, for purposes of this disclosure, the term "coupled" means the joining of two members directly or indirectly to one another. Such joining may be stationary in nature or moveable in nature and/or such joining may allow for the flow of fluids, electricity, electrical signals, or other types of signals or communication between the two members. Such joining may be achieved with the two members or the two members and any additional intermediate members being integrally formed as a single unitary body with one another or with the two members or the two members and any additional intermediate members being attached to one another. Such joining may be permanent in nature or alternatively may be removable or releasable in nature.

It is important to note that the construction and arrangement of the elements of temperature controlled case 10 and the multi-circuit cooling element 120 provided herein are illustrative only. Although only a few exemplary embodiments of the present disclosure have been described in detail in this disclosure, those skilled in the art who review this disclosure will readily appreciate that many modifications are possible in these embodiments (e.g., the number of inlets/outlets of the cooling element, the size and shape of the cooling element, etc.) without materially departing from the novel teachings and advantages of the disclosure. Accordingly, all such modifications are intended to be within the scope of the disclosure.

The present disclosure contemplates methods, systems and program products on any machine-readable media for accomplishing various operations. The embodiments of the present disclosure may be implemented using existing computer processors, or by a special purpose computer processor for an appropriate system, incorporated for this or another purpose, or by a hardwired system. Embodiments within the scope of the present disclosure include program products comprising machine-readable media for carrying or having machine-executable instructions or data structures stored thereon. Such machine-readable media can be any available media that can be accessed by a general purpose or special purpose computer or other machine with a processor. By way of example, such machine-readable media can comprise RAM, ROM, EPROM, EEPROM, CD-ROM or other optical disk storage, magnetic disk storage or other magnetic storage devices, or any other medium which can be used to carry or store desired program code in the form of machine-executable instructions or data structures and which can be accessed by a general purpose or special purpose computer or other machine with a processor. When information is transferred or provided over a network or another communications connection (either hardwired, wireless, or a combination of hardwired or wireless) to a machine, the machine properly views the connection as a machine-readable medium. Thus, any such connection is properly termed a machine-readable medium. Combinations of the above are also included within the scope of machine-readable media. Machine-executable instructions include, for example, instructions and data which cause a general purpose computer, special purpose computer, or special purpose processing machines to perform a certain function or group of functions.

Numerous specific details are described to provide a thorough understanding of the disclosure. However, in certain instances, well-known or conventional details are not described in order to avoid obscuring the description. References to "some embodiments," "one embodiment," "an exemplary embodiment," and/or "various embodiments" in the present disclosure can be, but not necessarily are, references to the same embodiment and such references mean at least one of the embodiments.

Alternative language and synonyms may be used for anyone or more of the terms discussed herein. No special significance should be placed upon whether or not a term is elaborated or discussed herein. Synonyms for certain terms are provided. A recital of one or more synonyms does not exclude the use of other synonyms. The use of examples anywhere in this specification including examples of any terms discussed herein is illustrative only, and is not intended to further limit the scope and meaning of the disclosure or of any exemplified term. Likewise, the disclosure is not limited to various embodiments given in this specification.

The elements and assemblies may be constructed from any of a wide variety of materials that provide sufficient strength or durability, in any of a wide variety of colors, textures, and combinations. Further, elements shown as integrally formed may be constructed of multiple parts or elements.

As used herein, the word "exemplary" is used to mean serving as an example, instance or illustration. Any implementation or design described herein as "exemplary" is not necessarily to be construed as preferred or advantageous over other implementations or designs. Rather, use of the word exemplary is intended to present concepts in a concrete manner. Accordingly, all such modifications are intended to be included within the scope of the present disclosure. Other substitutions, modifications, changes, and omissions may be made in the design, operating conditions, and arrangement of the preferred and other exemplary implementations without departing from the scope of the appended claims.

As used herein, the terms "approximately," "about," "substantially," and similar terms are intended to have a broad meaning in harmony with the common and accepted usage by those of ordinary skill in the art to which the subject matter of this disclosure pertains. It should be understood by those of skill in the art who review this disclosure that these terms are intended to allow a description of certain features described and claimed without restricting the scope of these features to the precise numerical ranges provided. Accordingly, these terms should be interpreted as indicating that insubstantial or inconsequential modifications or alterations of the subject matter described and claimed are considered to be within the scope of the invention as recited in the appended claims.

The background section is intended to provide a background or context to the invention recited in the claims. The description in the background section may include concepts that could be pursued, but are not necessarily ones that have been previously conceived or pursued. Therefore, unless otherwise indicated herein, what is described in the background section is not prior art to the description and claims and is not admitted to be prior art by inclusion in the background section.

What is claimed is:

1. A temperature controlled case comprising:

a housing that defines a temperature controlled space;

a multi-circuit cooling element in thermal communication with the temperature controlled space, the multi-circuit cooling element comprising:

two or more cooling coils, each of the cooling coils coupled to a different circuit structured to selectively circulate coolant through the multi-circuit cooling element, wherein each circuit is fluidly separate from each remaining circuit such that the coolant circulated through each circuit is not shared with each remaining circuit; and a plurality of heat exchange fins coupled to each of the two or more cooling coils such that each of the heat exchange fins facilitates heat removal from the temperature controlled space by each of the two or more cooling coils;

wherein a different primary refrigerant loop including a chiller is thermally coupled to each different circuit via the chiller, and each of the primary refrigerant loops is fluidly separate.

2. The temperature controlled case of claim 1, further comprising:

a first circuit coupled to a first cooling coil of the two or more cooling coils and configured to circulate a first coolant through the multi-circuit cooling element; and a second circuit coupled to a second cooling coil of the two or more cooling coils and configured to circulate a second coolant through the multi-circuit cooling element.

3. The temperature controlled case of claim 2, wherein:

the first circuit comprises a first condenser and a first compressor configured to circulate the first coolant between the first condenser and the first cooling coil of the multi-circuit cooling element; and the second circuit comprises a second condenser and a second compressor configured to circulate the second coolant between the second condenser and the second cooling coil of the multi-circuit cooling element.

4. The temperature controlled case of claim 1, further comprising a controller configured to operate one or more components of each circuit in:

a first operation mode in which the controller causes the coolant to circulate through only one of the cooling coils; and a second operation mode in which the controller causes the coolant to circulate through two or more of the cooling coils.

5. The temperature controlled case of claim 1, wherein the fins comprise a plurality of holes and the cooling coils pass through the fins via the plurality of holes.

6. The temperature controlled case of claim 1, wherein the fins are substantially parallel to each other and separated from each other by a predetermined distance along a length of the cooling coils.

7. A refrigeration system for a temperature controlled space, the refrigeration system comprising:

a multi-circuit cooling element in thermal communication with the temperature controlled space, the multi-circuit cooling element comprising a first cooling coil and a second cooling coil fluidly separate from the first cooling coil;

a first circuit fluidly coupled to the first cooling coil and configured to circulate a first coolant through the first cooling coil to provide cooling for the temperature controlled space, wherein the first circuit comprises a first chiller and a first pump configured to circulate the first coolant between the first chiller and the first cooling coil of the multi-circuit cooling element;

a second circuit fluidly coupled to the second cooling coil and configured to circulate a second coolant through the second cooling coil to provide cooling for the temperature controlled space, wherein the second circuit is fluidly separate from the first circuit such that the first coolant is not shared with the second circuit and the second coolant is not shared with the first circuit and wherein the second circuit comprises a second chiller and a second pump configured to circulate the second coolant between the second chiller and the second cooling coil of the multi-circuit cooling element;

a first primary refrigerant loop thermally coupled to the first circuit via the first chiller and configured to provide cooling for the first coolant in the first chiller; and a second primary refrigerant loop thermally coupled to the second circuit via the second chiller and configured to provide cooling for the second coolant in the second chiller, wherein the second primary refrigerant loop is fluidly separate from the first primary refrigerant loop.

8. The refrigeration system of claim 7, wherein the multi-circuit cooling element comprises a plurality of heat exchange fins coupled to both the first cooling coil and the second cooling coil such that each of the heat exchange fins facilitates heat removal from the temperature controlled space by both the first circuit and the second circuit.

9. The refrigeration system of claim 7, wherein:

the first circuit comprises a first condenser and a first compressor configured to circulate the first coolant between the first condenser and the first cooling coil of the multi-circuit cooling element; and the second circuit comprises a second condenser and a second compressor configured to circulate the second coolant between the second condenser and the second cooling coil of the multi-circuit cooling element.

10. The refrigeration system of claim 7, wherein:

the first primary refrigerant loop comprises a first condenser and a first compressor configured to circulate a first refrigerant between the first condenser and the first chiller; and the second primary refrigerant loop comprises a second condenser and a second compressor configured to circulate a second refrigerant between the second condenser and the second chiller.

11. The refrigeration system of claim 7, further comprising a controller configured to operate one or more components of the first circuit and the second circuit in:

a first operation mode in which the controller causes the first coolant to circulate through the first circuit and prevents the second coolant from circulating through the second circuit; and a second operation mode in which the controller causes the first coolant to circulate through the first circuit and causes the second coolant to circulate through the second circuit.

12. A refrigeration system for a temperature controlled space, the refrigeration system comprising:

a multi-circuit cooling element in thermal communication with the temperature controlled space, the multi-circuit cooling element comprising a first cooling coil and a second cooling coil;

a first circuit fluidly coupled to the first cooling coil and configured to circulate a coolant through the first cooling coil to provide cooling for the temperature controlled space;

a second circuit fluidly coupled to the second cooling coil and configured to circulate the coolant through the second cooling coil to provide cooling for the temperature controlled space;

a first primary refrigerant loop thermally coupled to the first circuit and configured to provide cooling to the coolant; and a second primary refrigerant loop thermally coupled to the second circuit and configured to provide cooling to the coolant, the second primary refrigerant loop being fluidly separate from the first primary refrigerant loop.

13. The refrigeration system of claim 12, wherein the multi-circuit cooling element comprises a plurality of heat exchange fins coupled to both the first cooling coil and the second cooling coil such that each of the heat exchange fins facilitates heat removal from the temperature controlled space by both the first circuit and the second circuit.

14. The refrigeration system of claim 12, wherein each of the first circuit and the second circuit comprise a chiller and a pump configured to circulate the coolant between the multi-circuit cooling element and the chiller.

15. The refrigeration system of claim 14, wherein the first primary refrigerant loop is thermally coupled to the the first circuit via a first chiller and configured to provide cooling for the coolant in the first chiller and the second primary refrigerant loop is thermally coupled to the second circuit via a second chiller and configured to provide cooling for the coolant in the second chiller.

16. The refrigeration system of claim 15, wherein the first primary refrigerant loop comprises a condenser and a compressor configured to circulate a refrigerant between the condenser and the first chiller.

17. The refrigeration system of claim 12, further comprising a controller configured to operate one or more components of the first circuit and the second circuit in:

a first operation mode in which the controller causes the coolant to circulate through the first circuit and prevents the coolant from circulating through the second circuit; and a second operation mode in which the controller causes the coolant to circulate through both the first circuit and the second circuit.

18. The refrigeration system of claim 17, wherein the controller is configured to operate one or more components of the first primary refrigerant loop and the second primary refrigerant loop in:

the first operation mode in which the controller causes refrigerant to circulate through the first primary refrigerant loop and prevents refrigerant from circulating through the second primary refrigerant loop; and the second operation mode in which the controller causes refrigerant to circulate through both the first primary refrigerant loop and the second primary refrigerant loop.

19. The refrigeration system of claim 18, wherein in the first operation mode, the controller is configured to activate a first compressor and selectively open a valve in the first primary refrigerant loop to circulate refrigerant through the first primary refrigerant loop.

20. The refrigeration system of claim 19, wherein in the second operation mode, the controller is configured to activate a second compressor to circulate refrigerant through the second primary refrigerant loop.

* * * * *